United States Patent [19]

Francois et al.

[11] 4,040,815

[45] Aug. 9, 1977

[54] VERY FINELY DIVIDED LITHIUM AND PROCESS FOR MANUFACTURING SAME

[75] Inventors: Bernard Francois, Strasbourg; Michel Vernois, Puteaux; Paul Martin, Lutzelhouse; Emile Franta, Souffelweyershein, all of France

[73] Assignee: Agence Nationale de Valorisation de la Recherche (ANVAR), Neuilly sur Seine, France

[21] Appl. No.: 653,747

[22] Filed: Jan. 30, 1976

[30] Foreign Application Priority Data

Feb. 7, 1975 France ..... 75.03890

[51] Int. Cl.[2] ..... C22C 1/04

[52] U.S. Cl. ..... 75/.5 B; 252/476

[58] Field of Search ..... 75/.5 B; 252/476

[56] References Cited

U.S. PATENT DOCUMENTS

| | | | |
|---|---|---|---|
| 2,037,672 | 4/1936 | Zeiss | 75/.5 B |
| 2,969,281 | 1/1961 | Monson | 75/.5 B |
| 3,434,831 | 3/1969 | Knopp | 75/.5 B |
| 3,449,115 | 6/1969 | Glamiche et al. | 75/.5 B |
| 3,563,730 | 2/1971 | Bach et al. | 75/.5 B |
| 3,840,364 | 10/1974 | Flemings et al. | 75/.5 B |
| 3,957,532 | 5/1976 | Settle et al. | 75/.5 B |

*Primary Examiner*—W. Stallard

*Attorney, Agent, or Firm*—Hammond & Littell

[57] ABSTRACT

Very finely divided lithium.

A mixture of inert gas and fine particles of lithium in suspension in the said gas is filtered on a bed of solid bodies which can be stirred, the mesh size of said bodies, the height of said bed and the speed of stirring being such that the metal particles are retained without causing the formation of a metallic slab on the surface.

The suspensions of fine lithium particles in solutions are stable.

6 Claims, 2 Drawing Figures

VERY FINELY DIVIDED LITHIUM AND PROCESS FOR MANUFACTURING SAME

The invention relates to the field of finely divided metals and its object is more particularly very finely divided lithium.

Lithium is used in many polymerizations in the form of organolithium compounds manufactured from divided lithium, or in the form of divided lithium itself.

In the prior art, various processes have been used to divide lithium. For example, the decomposition in a vacuum of the liquid combination of ammonia and the desired amount of metal has already been suggested, but this process has many drawbacks: the conditions of decomposition are difficult to replicate and result in different catalyst surfaces at each experiment. Another process consisted in the rapid stirring of molten lithium in vaseline, making it possible, after washing and filtration, to obtain a suspension of lithium in benzene, the size of the metal particles being greater than 20 microns.

Another process known in the prior art was that of dividing alkaline-earth metals (calcium, baryum and strontium) by entrainement of the vapour from a strongly heated metal by a stream of argon, which is first hot and then cold, resulting in the formation of fine metal particles which are recovered on a wire-wool pad, on glass balls, in an inert solvent or directly in the reaction mixture (C.R. Acad. Sc. Paris t 262, p 541 – 544 (Feb. 14, 1966) and thesis Claude Mathis, at Strasbourg, Apr. 15, 1970, pages 3 and 4).

The present invention applies the known technique for alkaline-earths to the manufacture of finely divided lithium, by adapting the process to the physical and mechanical characteristics of lithium; it has as its object the manufacture of finely divided lithium (in the order of $10^{-1}\mu$) and a device adapted to embody said process.

The technique developed consists in entraining in a stream of gas inert with respect to lithium, such as argon or helium, the metallic vapour produced by heating lithium in a furnace. The mixture of inert gas and metallic vapours is cooled suddenly thus causing the condensation of fine metal particles having a chemically clean surface and a mean size in the order of $10^{-4}\mu$. The yield of said preparation and the size of the particles can be controlled by varying the temperature of the molten lithium, and the velocity of the inert gas entraining the metallic vapours. The fine particles of lithium formed after sudden cooling of the vapour must be recovered, this step raises numerous problems owing to the physical characteristics of lithium and the particles obtained; said metal is soft and reagglomerates very easily.

The device known in the prior art and intended for recovering particles of alkaline-earth metals cannot be used for lithium; for instance, a fritted glass filter normally considered by a man skilled in the art as being effective for the filtration of fine alkaline-earth particles such as calcium or strontium, leads in the case of lithium to the formation of a porous slab which it is impossible to redisperse subsequently in a liquid. Similarly, a device consisting of a cylinder filled to $\frac{2}{3}$ of its height by 2 mm diameter glass balls and without a stirring device is suitable for coarse alkaline-earth particles but is not sufficiently efficient for very fine particles.

It has now been found possible to recover fine lithium particles by a new device consisting of a stacking of balls which can be stirred. The size of the balls is critical as, if they are too small, there is increased loss of pressure and the device is very likely to become blocked up because a compact metal layer rapidly forms on the surface, and said layer cannot subsequently be broken up. If, on the other hand, the balls are too big, the filtration efficiency decreases rapidly and must be compensated by increasing the height of the bed of balls.

It is also essential to provide a device for renewing the balls: Said device is adapted to submit the said balls to a movement such that once the top balls are covered with a thin layer of metal powder they are replaced by "clean" balls in order to avoid the formation of a metal slab on the surface. The greater the efficiency of said renewal the smaller the balls may be. Said movement can be obtained by any suitable means, notably by an Archimedean screw.

According to the invention, the average diameter of the balls can be in the range of from about 2 mm to about 0.2 mm, and preferably from 1 mm to 0.1 mm.

The balls can be made of any material which does not react with lithium, for example, glass or steel; they should have a chemically clean surface and can, therefore, be washed in solvents such as benzene, or an alcohol and/or in an acid. Optionally, said marbles can be silanized with $Si(CH_3)_3Cl$ for instance, to replace OH by $—O—Si(CH_3)_3$.

The process for preparing very finely divided lithium is characterized by filtering a mixture of inert gas and fine particles of lithium in suspension in the said gas on a bed of solid bodies capable of being stirred, the mesh size of said bodies, height of said bed and the velocity of agitation being such that the metal particles are retained without inducing the formation of a metal slab on the surface.

A further object of the invention, as a new product and new means, is finely divided lithium particles characterized in that the mean size of said particles is less than $2\mu$ and preferably less than $1\mu$ and consisting of the agglomeration of elementary particles having a mean diameter of about 200 Angstroms. The said particles are considerably smaller than those which could be obtained in the prior art and make it possible to obtain suspensions in liquids such as heptane or hexane which do not decant, whereas trials conducted with the suspensions obtained, for example, by the vaseline process, result in suspensions which decant in a few hours, or less, the lithium rising to the surface; such a result, which is very important for organolithium chemistry, is an original and unexpected characteristic of the invention.

The lithium particles according to the invention are further characterized by a chemically clean surface due to the particular process by which they are obtained, said cleanliness, and the small size of the particles, contributing to increasing the reactivity of said particles in organolithium chemistry, which results in higher yields and greater reaction velocities.

The very finely divided lithium according to the invention can find applications in all types of reaction in which metallic lithium or organolithium derivatives are used. The very finely divided lithium can, notably, be used in the natural state as a polymerization catalyst. Said application is the object of a French Patent Application and corresponding U.S. application, Ser. No. 653,749 also filed today for "Polymerizations catalyzed by very finely divided lithium".

The device adapted to embody the process of the invention comprises a furnace, preferably heated electrically; the furnace itself can be formed of three concentric tubes, preferably of stainless steel. At the bottom of the outer tube there is positioned a boat in which is placed the crude lithium to be treated; the outer tube is in direct contact with the furnace. An inert gas, previously purified by known processes, is caused to arrive between the two tubes. The second tube is of a length such that the inert gas comes out of the space between the first two tubes adjacent to the surface of the lithium in fusion; said gas is heated by being passed between the 2 tubes and does not therefore cool the molten metal it touches. The mixture of inert gas and the metallic vapours it entrains is diluted, before leaving the apparatus, by an additional stream of previously cooled inert gas. For this, said gas stream flows between the second and third tube, which is cooled by circulation of water. The second stream of inert gas acts in two ways: first it very rapidly cools the lithium vapour and the metallic particles which are formed, thus cooling said particles to a temperature at which they only adhere together very slowly, and second, it dilutes the lithium particles to ensure said particles being separated from one another.

It is possible to control the size of the lithium particles obtained by varying the respective flow rates of the hot gas and the cold gas.

The grains of lithium obtained are sufficiently small (mean $\phi = 0.1\mu$) to pass through small diameter pipework without leaving s deposit on the walls thereof.

At the furnace outlet, the lithium particles can be recovered on a pile of balls disposed on a fine grid; in order to avoid the drawbacks previously described, the balls should have a diameter in the order of 5/10 mm. To ensure the glass balls being evenly covered, they are subjected to very slow stirring with a screw at regular intervals, for example, 1 rotation in 5 seconds or, again, 1 rotation/second for ten seconds every half-hour.

Once the metal particles have been filtered, the inert gas which can, for example, be argon, is recycled so that only a small amount of argon is necessary for the process; furthermore, the inert gas is purified during the first cycles by the metallic vapour. The small amounts of nitride and oxide which form at this moment can be isolated, by a by-pass filter for instance. This recycling of argon ensures perfect chemical cleaning of the metal surface.

The device of the invention will be illustrated hereinafter, purely by way of explanation and not in any limitative a sense, with reference to the appended drawings wherein.

Figure 1:
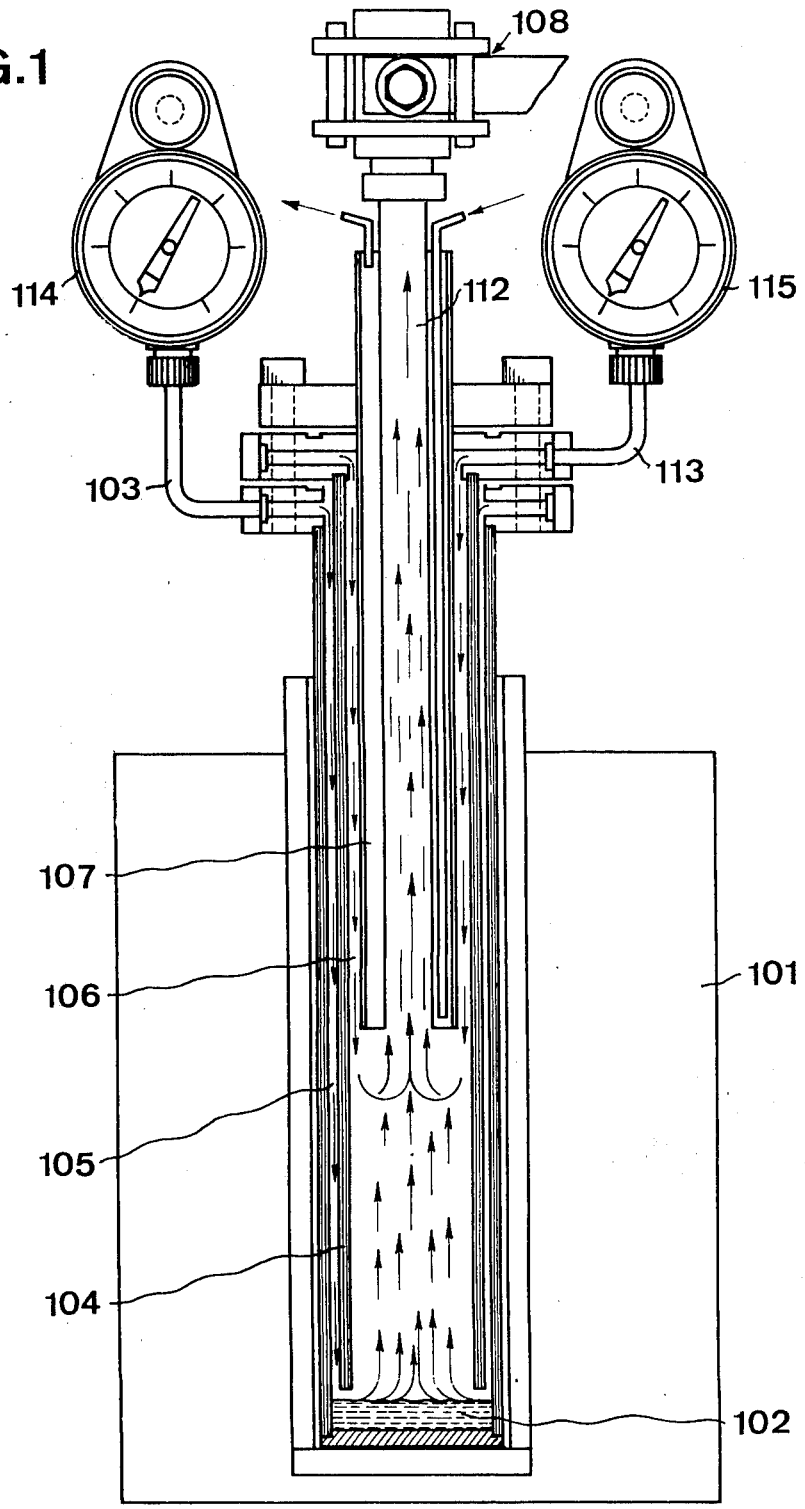
FIG. 1 is a cross-sectional view of the furnace used in the invention.

FIG. 1 shows an embodiment of the furnace of the invention; the furnace body 101 heats the boat in which the lithium 102 is placed. The inert gas, such as argon, to be heated or cooled is introduced at respectively 103 and 113, manometers 114 and 115 enable said gas flows, respectively to be regulated and controlled. The hot (105) and cold (106) gas streams, separated by tube 104, emerge at 112 and 108 entraining fine lithium particles. Reference 107 represents a water cooling tube.

Figure 2:
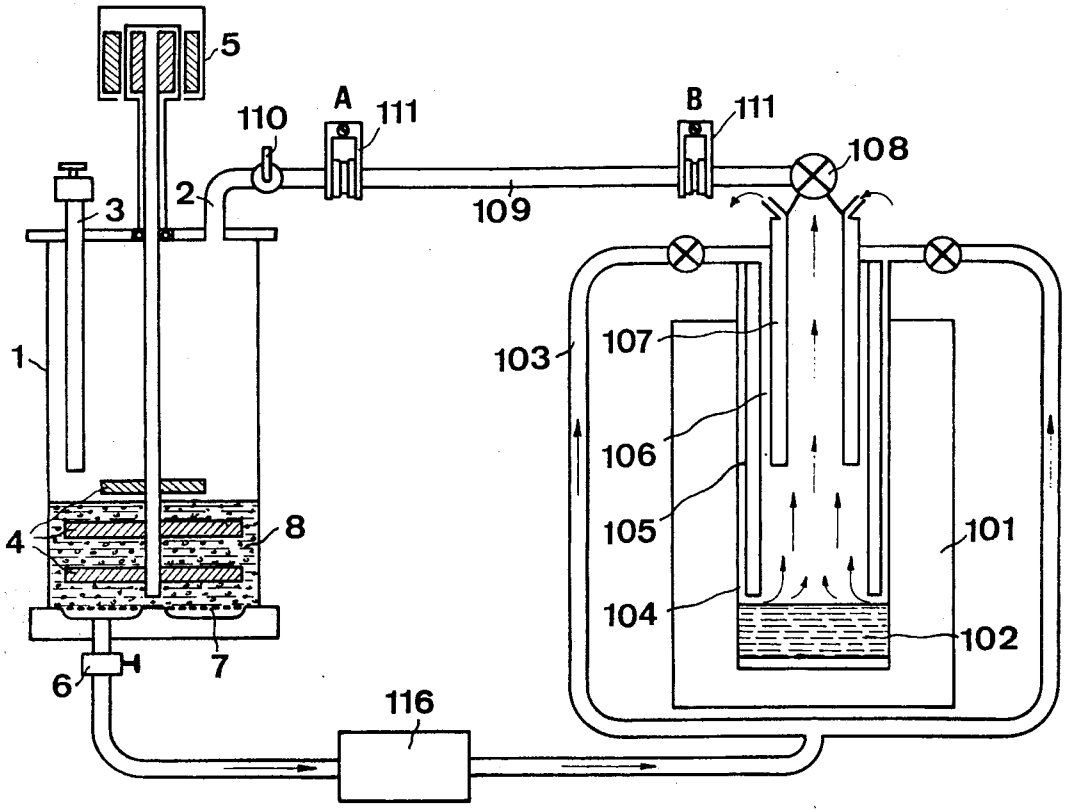
FIG. 2 shows the entire device, with the furnace of FIG. 1 and the means adapted to recover the finely divided lithium particles, which are another object of the invention.

FIG. 2 shows an embodiment of a device making it possible to obtain finely divided lithium, the furnace 101 is similar to the furnace shown in FIG. 1, the side plates with 0 rings 111 enabling the furnace and the reactor to be disconnected, the fine particles leaving the furnace at 108 (ball valve), pass into conduit 109, the ball valve 110, inlet 2 of the reactor 1 and are deposited on glass balls 8 having a mean diameter in the order of 5/10 mm; said balls, which lie on a fine metal grid 7, are agitated by the stirrer 4 driven by motor 5. The gas, free of lithium particles filtered by the bed of balls, leaves the reactor at 6, device 116 making it possible to isolate the small amounts of nitride and oxide which form when the gas first flows, this can, for example, be a by-pass filter, said device 116 also comprising a pump, such as a membrane type pump, which makes it possible to ensure a sufficient pressure and flow rate to reintroduce the inert gas into the furnace. A solvent can be introduced at 3 in order to obtain a fine suspension of lithium particles by stirring.

The following example is intended to illustrate a mode of embodiment of the invention.

The experimental device was similar to that shown in FIG. 2.

To finely divided 50 g of lithium, a furnace was used having a total height of 500 mm, the diameter of the outer tube being 60 mm, the temperature of the level of the lithium being in the order of 750° C.

The flow rate of hot argon was approximately 2 l/mn, that of cold argon being in the order of 4 l/mn.

Said furnace was connected to the reactor by a glass tube of 1 cm inner diameter and 10 cm in length.

The glass reactor, of a total height of 350 mm and a diameter of 100 mm, comprised an opening at the lower portion thereof and a metal grid gas positioned on which a 80 mm thick bed of 5/10 mm diameter balls was placed. The balls were stirred every half-hour for 10 seconds at a speed of 1 r/s.

The average overpressure of argon in the device was in the order of 0.2 bar.

The duration of such a distillation was 7 hours.

Finely divided lithium depositied on the glass balls of the reactor was thus obtained.

The lithium particles obtained by the present process are in the form of fine elementary agglomerated particles, they are therefore not spherical and thereforehave a large specific surface.

Their average size was about $0.1\mu$ composed by elementary particles of about 200 A.

We claim:

1. A process for preparing very finely divided lithium comprising filtering a mixture of inert gas and fine particles of lithium in suspension in the said gas on a bed of solid bodies which can be renewed, notably by stirring, the mesh size of said bodies, the height of said bed and the speed of stirring being such that the metal particles are retained without causing a metallic slab to be formed on the surface.

2. A process according to claim 1, wherein the mixture of gas and fine particles of lithium is obtained by heating lithium and the entrainment of the metallic vapours formed successively by a hot inert gas and a cooled inert gas, the latter inducing the formation of fine solid lithium particles and diluting the mixture obtained.

3. A process according to claim 2, wherein the solid bodies are balls made of a material inert with respect to lithium, such as glass or steel.

4. A process according to claim 3, wherein the balls have a diameter in the range of 2 mm to 0.2 mm.

5. A process according to claim 4, wherein the diameter of the balls is 5/10 mm, the height of the bed being 80 mm, the stirrer rotating for 10 seconds every half-hour at a rate of 1 r/s.

6. A process according to claim 5, wherein the inert gas is helium or argon.

* * * * *